United States Patent [19]

Schambeck

[11] Patent Number: 4,513,465

[45] Date of Patent: Apr. 30, 1985

[54] STIFFENING GIRDER FOR A STAYED CABLE BRIDGE

[75] Inventor: Herbert Schambeck, Frieding-Andechs, Fed. Rep. of Germany

[73] Assignee: Dyckerhoff & Widmann Aktiengesellschaft, Munich, Fed. Rep. of Germany

[21] Appl. No.: 406,995

[22] Filed: Aug. 10, 1982

[30] Foreign Application Priority Data

Aug. 17, 1981 [DE] Fed. Rep. of Germany ..... 3132398

[51] Int. Cl.[3] ..... E01D 11/00

[52] U.S. Cl. ..... 14/17; 14/18; 52/602

[58] Field of Search ..... 14/18, 19, 20, 17, 6, 14/24, 73, 1; 52/602, 691, 227

[56] References Cited

U.S. PATENT DOCUMENTS

| | | | |
|---|---|---|---|
| 562,191 | 6/1896 | Mitchell | 14/18 X |
| 755,724 | 3/1904 | Tomlinson | 14/18 X |
| 890,769 | 6/1908 | Hewett | 52/602 X |
| 948,215 | 2/1910 | Fitzpatrick | 52/227 X |
| 2,402,125 | 6/1946 | Chapman | 14/20 |
| 3,323,263 | 6/1967 | Adams | 52/691 X |
| 3,673,624 | 7/1972 | Finsterwalder et al. | 14/19 |
| 3,794,433 | 2/1974 | Schupack | 52/227 X |
| 3,853,162 | 12/1974 | Menge | 52/691 X |
| 3,859,682 | 1/1975 | Sulkiewicz | 14/18 X |

FOREIGN PATENT DOCUMENTS

| | | | |
|---|---|---|---|
| 1166806 | 4/1964 | Fed. Rep. of Germany | 14/6 |
| 1184370 | 12/1964 | Fed. Rep. of Germany | 14/21 |
| 1230062 | 12/1966 | Fed. Rep. of Germany | 14/18 |
| 2938029 | 4/1981 | Fed. Rep. of Germany | 14/17 |
| 113108 | 5/1968 | Norway | 14/18 |
| 416711 | 1/1967 | Switzerland | 14/73 |
| 984683 | 3/1965 | United Kingdom | 14/73 |

*Primary Examiner*—Stephen J. Novosad
*Assistant Examiner*—Beverly E. Hjorth
*Attorney, Agent, or Firm*—Toren, McGeady, Stanger, Goldberg & Kiel

[57] ABSTRACT

A stiffening girder for a stayed cable bridge, constructed of reinforced concrete or prestressed concrete, is formed by a closed multi-cell box extending in the long direction of the bridge. The upper part of the box is a substantially horizontally extending roadway slab. Webs extending downwardly from the roadway slab and in the long direction of the bridge combine with the roadway slab to form at least a part of the multi-cell box. The webs can be vertically arranged or obliquely inclined relative to the roadway slab. Further, a bottom slab spaced downwardly from the roadway slab may complete the box. The girder or box is supported by inclined cables extending in at least one support plane along the long direction of the bridge. The cables can be attached to the girder along its center line in the long direction or at symmetrical locations positioned outwardly from the center line.

8 Claims, 9 Drawing Figures

STIFFENING GIRDER FOR A STAYED CABLE BRIDGE

SUMMARY OF THE INVENTION

The present invention is directed to a stiffening girder for a stayed cable bridge in the form of a closed multi-cell box including a roadway slab, webs extending vertically and/or obliquely downwardly from the slab and possibly a bottom slab. The box is supported by inclined cables arranged in one or more support planes extending in the long direction of the bridge.

A stiffening girder for a stayed cable bridge normally rests on the end abutments of the bridge and on one or more piers positioned between the abutments. In the regions between the abutments, the girder is suspended by straight cables arranged parallel to one another or by fan-shaped cables extending obliquely upwardly to a tower supported on a pier. The stiffening girder transmits the dead weight of the roadway and the live traffic loads acting on the roadway in the transverse direction of the bridge to the suspension points of the cables where these loads are removed by the cables. As a result, horizontal compressive forces are present in the stiffening girder. In addition, mainly due to the traffic loads, bending moments in the longitudinal direction of the bridge are developed in the stiffening girder in the regions between the suspension points of the cables. Since its positive and negative components are approximately the same, a closed box-shaped cross-section is especially advantageous for use as the stiffening girder. Moreover, because of its considerable torsion stiffness, a closed box-shaped cross-section is often very desirable, though not absolutely necessary.

Normally the support cables are arranged in one support plane extending in the long direction of the bridge, that is, a vertically extending central support plane, or in two support planes spaced outwardly from the center line of the bridge. In the case of wide bridges, the transverse dimension of the stiffening girder can be very great. Accordingly, special importance is attached to the removal of the forces acting in the transverse direction. For removing such forces additional transverse girders are generally incorporated into the stiffening girder. With regard to the dead load on such a bridge, however, transverse girders constitute dead weight, as does the roadway pavement, and increase the compressive stresses in the stiffening girder. The situation is similar for tensile or compressive diagonal rods, which occasionally have been disposed internally or externally of the closed box shape, to provide a system capable of supporting loads in the transverse direction.

Therefore, it is the primary object of the present invention to dispense with transverse girders or similar structural members in a stiffening girder of the kind mentioned above and used in stayed cable bridges for accommodating loads acting in the transverse direction so that the weight of such members does not add to the dead weight on the bridge.

In accordance with the present invention, the structural members forming the box-shaped cross-section extend in the long direction of the bridge and are in the form of plate members which in the transverse cross-section of the bridge form a truss-like arrangement capable of accommodating vertical loads, or at least a certain combination of loads acting at the junction points, without requiring any additional structural elements extending in the transverse direction of the bridge, such as transverse girders, tension or compression diagonal rods or the like, for transmitting the loads to the support plane or planes of the cables.

The truss-like arrangement may be a triangular truss symmetrical to the center line of the bridge with the longitudinally extending webs forming diagonal rods, while the roadway slab forms the upper chord of the truss and the bottom slab the lower chord. The stiffening girder may be suspended in a single support plane with the supporting cables secured to the stiffening girder along the center line of the bridge or in a pair of laterally spaced support planes which engage the outermost ends of the truss-like arrangement.

The truss-like arrangement may be a triangular form symmetrical to the center line of the bridge with webs extending in the long direction of the bridge forming the diagonal rods, with the roadway slab forming the upper chord and a bottom slab forming the lower chord of the truss. The stiffening girder may be suspended along a support plane disposed on the center line of the bridge or in a pair of laterally spaced support planes extending along the outer edges of the stiffening girder.

The truss-like arrangement, symmetrical to the center line of the bridge, may include at the center at least one rectangular truss having vertical rods with triangular trusses on the opposite sides of the rectangular truss formed by diagonal rods extending between the upper chord and lower chord of the truss. In such an arrangement, the roadway slab forms the upper chord and the bottom slab forms the lower chord. Such a stiffening girder can be suspended in two support planes extending along the opposite vertically extending sides of the rectangular truss or at support planes extending along the outer edges of the box-shaped girder. Further, the truss-like arrangement may be in the form of an inverted arch with the arch-shaped lower chord supporting the roadway slab via vertical rods. The box-like girder can be supported along its edges.

In a stiffening girder embodying the present invention, all of the structural parts forming the box-shaped girder constitute, in the long direction of the bridge, longitudinally extending plate members which form a truss-like arrangement in the transverse direction of the bridge capable of accommodating the loads acting on the bridge without requiring any additional structural elements, such as transverse girders or diagonal rods or bars extending between the support planes. Depending on the cross-sectional arrangement of the stiffening girder, the junction points in the truss, as in a regular truss, acts as joints so that the "truss rods" receive not only longitudinal forces, but to some extent bending moments can be absorbed in the junction points. In addition with the present invention, there is the advantage that the entire cross-section of the stiffening girder acts in the long direction of the bridge in absorbing compressive forces and additional structural members serving only to handle transversely extending loads are not required. Such additional structural members would only add to the dead weight of the stiffening girder. By eliminating such additional structural members the compressive stress developed in the cross-section is reduced, permitting longer spans and a more economical construction.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
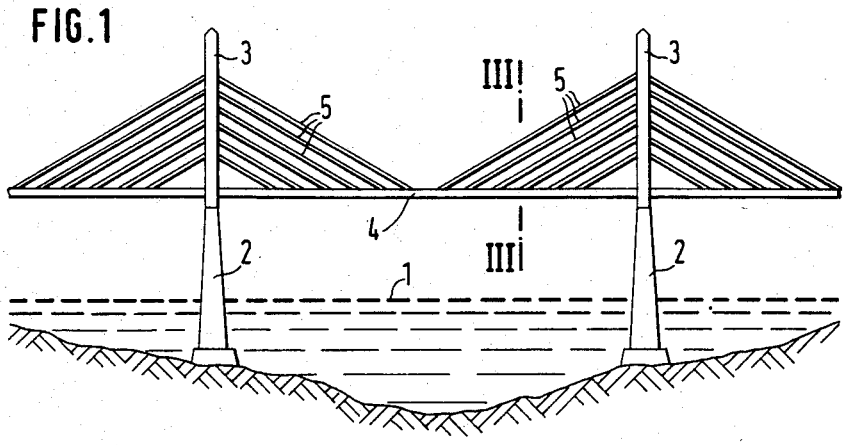
FIG. 1 is a schematic side view of a stayed cable bridge.
Figure 2:
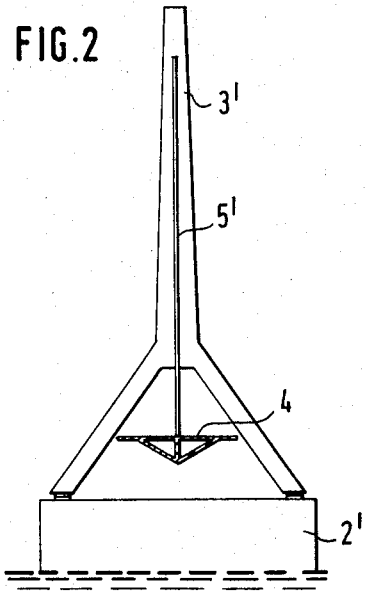
FIG. 2 is a transverse section through a stayed cable bridge with a single support plane suspending the stiffening girder.
Figure 3:
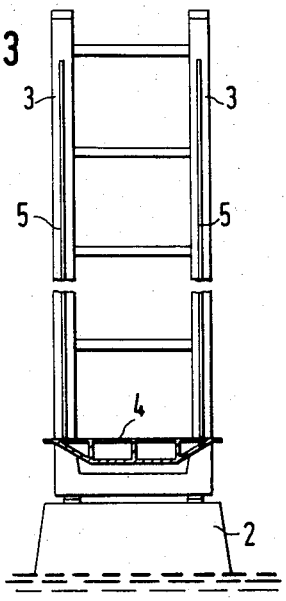
FIG. 3 is a transverse section through a stayed cable bridge with a pair of support planes for the stiffening girder, and the section taken along the line III—III in FIG. 1.

The basic construction of a stayed cable bridge is illustrated in FIGS. 1, 2 and 3, the bridge passes over a body of water having a water surface 1 with piers 2 extending upwardly from the bottom of the body of water to a point above the water surface, with towers 3, 3' extending upwardly from the piers. A stiffening girder 4 serving also as the roadway slab, is suspended from cables 5, 5', arranged in a central support plane as shown in FIG. 2 extending along the center line of the bridge or in two laterally spaced support planes, note FIG. 3, spaced outwardly on both sides of the bridge center line. The cables 5, 5' are inclined relative to the towers 3, 3' and to the girder 4 and are anchored at one end to the towers 3,3' and at the other ends to the stiffening girder 4. The illustration of the bridge abutments has been omitted in the interest of simplicity.

In a stayed cable bridge embodying the present invention, at least the stiffening girder 4 is constructed of reinforced concrete or prestressed concrete. Preferably, the towers 3, 3' are formed of reinforced concrete, as are the piers 2, 2'. The cables 5, 5' may be formed as desired.

In FIGS. 4 to 9, six different arrangements of the stiffening girder 4 are illustrated, all embodying the present invention.

Figure 4:
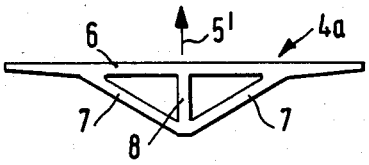
FIGS. 4 to 9 are schematic side views illustrating various embodiments of the truss-like stiffening girder embodying the present invention.
Figure 5:
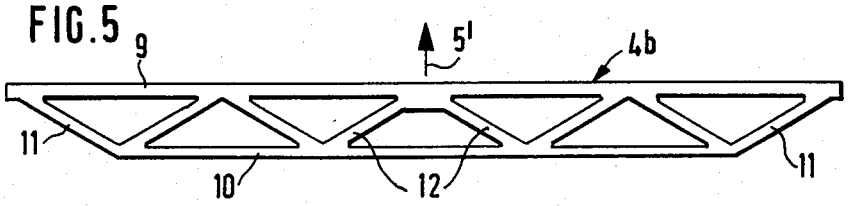

The stiffening girders 4*a* and 4*b* illustrated in FIGS. 4 and 5 are intended to be supported in a single support plane by cables 5' located along the center line of the bridge. The stiffening girder 4*a* is made up of a roadway slab 6 forming the upper part of the girder, a pair of longitudinally extending webs 7 extending obliquely of the slab 6, and a vertically arranged longitudinally extending web 8 extending between the roadway slab and the junction of the webs 7. As a result, a closed multicell box is formed by the stiffening girder 4*a*. The roadway slab 6 along with the webs 7, 8 act in the direction transverse to the center line or long direction of the bridge as parts of a truss-like arrangement. In the long direction of the box or girder the various members making up the box absorb compressive forces as well as bending moments in the long direction, and torsion moments.

The stiffening girder 4*b* shown in FIG. 5 is suitable for a correspondingly wider roadway. Roadway slab 9 forms the upper chord of the truss-like arrangement and a continuous bottom slab 10 forms the lower chord. The opposite longitudinally extending sides of the box girder are closed by longitudinally extending webs 11 extending obliquely of the upper and lower chords. Similarly, inwardly of the webs 11 and extending obliquely between the roadway slab 9 and the bottom slab 10 there are longitudinal extending webs 12 which form the diagonal rods of the truss-like arrangement acting in the transverse direction as tension and compression diagonals and in the long direction of the bridge as compression members along with the roadway slab 9 and the bottom slab 10.

Both of the transverse cross-sectional forms shown in FIGS. 4 and 5 have a pure truss carrying effect, that is, all vertical loads acting at the junction of the truss members are transmitted without any bending moments.

Figure 8:
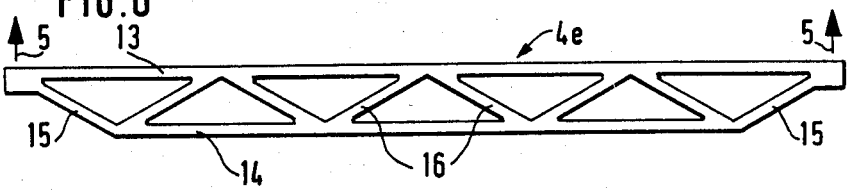

A similar design is the stiffening girder 4*e* illustrated in FIG. 8 which is suspended by inclined cables 5 disposed in a pair of support planes extending along the opposite edges of the girder. In this girder there is a roadway slab 13, a bottom slab 14 spaced downwardly from the slab 13, two outer webs 15 extending in the long direction of the bridge and disposed obliquely of the roadway slab and the bottom slab, and additional longitudinal extending webs 16 located inwardly of the webs 15 and disposed obliquely of the roadway slab and the bottom slab. This girder acts exclusively as a truss in the transverse direction of the bridge in the same manner as the stiffening girder in FIG. 5.

Figure 6:
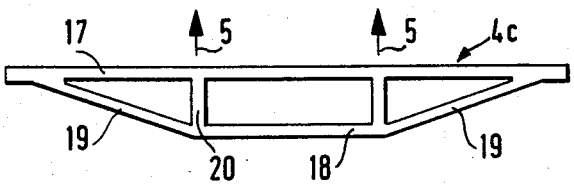
Figure 7:
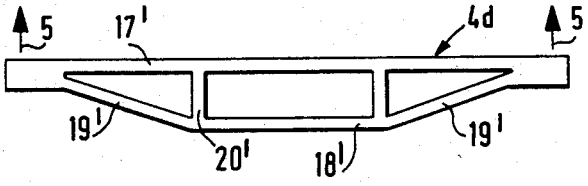

Utilizing the stiffening girders 4*c* and 4*d* displayed in FIGS. 6 and 7, all symmetrical junction loads are transferred free of bending moments. These stiffening girders are each made up of a roadway slab 17, 17', a bottom slab 18, 18', outer longitudinally extending webs 19, 19' disposed obliquely of the slabs, and interior vertically arranged longitudinally extending webs 20, 20'. The difference between these two girders is in the suspension, the stiffening girder 4*c* in FIG. 6 has the support planes for the cables 5 located above the interior webs 20, while the stiffening girder 4*d* in FIG. 7 has the support planes located along the outside edges of the girder.

Figure 9:
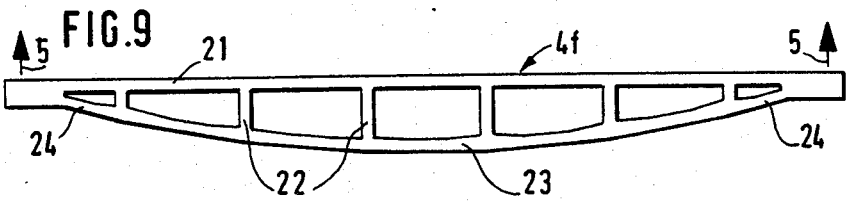

In the stiffening girder 4*f* displayed in FIG. 9, only certain symmetrical junction loads are transferred without bending moments. In this embodiment, the box-shaped stiffening girder is formed as a so-called tension arch. Roadway slab 21 is supported by vertically arranged longitudinally extending webs 22 on an inverted arch-shaped tension member 23 which transfers the horizontal forces resulting from tensile forces in the bearing region 24 into the roadway slab 21 as compressive forces. With this stiffening girder, the entire cross-section acting in the transverse direction participates in the absorption of the compressive forces in the longitudinal direction.

In the arrangements shown in FIGS. 6, 7 and 9, any loads acting at the junction points, in particular traffic loads, create transverse bending moments in the slabs. These moments and other moments formed by locally applied forces, in particular separate traffic loads, are so small, that they do not require reinforcement of the slabs and, as a result, do not adversely affect the economic efficiency of the construction.

While specific embodiments of the invention have been shown and described in detail to illustrate the application of the inventive principles, it will be understood that the invention may be embodied otherwise without departing from such principles.

I claim:

1. Stiffening girder, formed of one of reinforcing concrete and prestressed concrete, for a stayed cable bridge comprising a multi-cell box elongated in the long direction of said bridge and closed in the elongated direction, means for supporting said box including cables inclined in the elongated direction of and secured to said box, said cables arranged in at least one upwardly extending support plane extending in the elongated direction of and upwardly from said box, said box comprising only parts having the long dimension thereof extending in the long direction of said box and being free of parts having the long dimension thereof extending transversely of the long direction of said box, said box comprising a generally horizontally extending continuous roadway slab forming the upper part of said box and having a pair of opposite edges extending in the long direction of said box, at least a plurality of webs extending downwardly from said roadway slab with said webs elongated in the long direction of said box and extending continuously along the underside of said roadway slab, at least one said web located interiorly within said box, and a continuous bottom slab spaced downwardly from said roadway slab with said webs extending between said roadway slab and bottom slab, said roadway slab said webs and said bottom slab each comprises a plate-like member extending in the elongated direction of said box and said roadway slab said webs and said bottom slab form a truss extending in the direction transverse to the elongated direction of said box and capable of transferring vertical loads at the junction points of said truss whereby said truss is capable of transferring the forces acting in said box to said means for supporting said box without the use of additional structural members, such as transverse girders, tension or compression diagonal rods and the like, extending in the direction transverse to the long direction of said box, and at least some of said webs extending at an acute angle relative to the plane of said roadway slab and a different one of said webs located adjacent to each of said opposite edges of said roadway slab and extending upwardly at an acute angle relative to said roadway slab and bottom slab from said bottom slab to a location on said roadway slab adjacent to the corresponding one of said opposite edges.

2. Stiffening girder, as set forth in claim 1, wherein the truss-like arrangement of said roadway slab and webs forms a triangular truss symmetrical to the center line of the bridge, with said webs forming diagonal members of the truss and said roadway slab forming the upper chord of the truss.

3. Stiffening girder, as set forth in claim 2, wherein said bottom slab forms the lower chord of the truss.

4. Stiffening girder, as set forth in claim 2 or 3, wherein the support plane of said cables is located at a junction of said webs and said roadway slab and extends along the center line of the bridge.

5. Stiffening girder, as set forth in claim 2 or 3, wherein said box is supported from said cables in a pair of said support planes disposed in laterally spaced relation with each of said support planes extending along one of said edges of said roadway slab.

6. Stiffening girder, as set forth in claim 1, wherein the truss is symmetrical to the center line of the bridge and includes at least one rectangular truss in the center line portion of the box with vertical said webs defining the sides of the rectangular truss and at least one triangular truss located along each of the opposite sides of the rectangular truss and with said webs extending at an acute angle to said roadway slab defining the outer sides of said triangular trusses, and said bottom slab spaced downwardly from said roadway slab forming the lower chord of the truss and the roadway slab forming the upper chord thereof.

7. Stiffening girder, as set forth in claim 6, wherein said box is supported from said cables along a pair of said support planes with said support planes aligned above said vertically extending webs.

8. Stiffening girder, as set forth in claim 6, wherein said box is supported from said cables along two said support planes each located along one of said opposite edges of said roadway slab.

* * * * *